US010308476B2

(12) United States Patent
Kim

(10) Patent No.: US 10,308,476 B2
(45) Date of Patent: Jun. 4, 2019

(54) ELEVATOR CONTROL SYSTEM HAVING CONTROLLER IN COMMUNICATION WITH POWER PROVIDER

(71) Applicant: Otis Elevator Company, Farmington, CT (US)

(72) Inventor: HanJong Kim, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 482 days.

(21) Appl. No.: 15/027,771

(22) PCT Filed: Oct. 8, 2013

(86) PCT No.: PCT/US2013/063772
§ 371 (c)(1),
(2) Date: Apr. 7, 2016

(87) PCT Pub. No.: WO2015/053746
PCT Pub. Date: Apr. 16, 2015

(65) Prior Publication Data
US 2016/0244294 A1 Aug. 25, 2016

(51) Int. Cl.
*B66B 1/28* (2006.01)
*B66B 1/24* (2006.01)

(52) U.S. Cl.
CPC ..... *B66B 1/2408* (2013.01); *B66B 2201/216* (2013.01); *B66B 2201/241* (2013.01)

(58) Field of Classification Search
CPC ..... B66B 1/2408; B66B 2201/216; B66B 2201/241
(Continued)

(56) References Cited

U.S. PATENT DOCUMENTS 4,771,865 A * 9/1988 Hinderling ..... B66B 5/0006 187/391
4,989,695 A * 2/1991 Kubo ..... B66B 1/18 187/247
(Continued)

FOREIGN PATENT DOCUMENTS

CN 102862881 A 1/2013
JP 2013063825 A 4/2013
(Continued)

OTHER PUBLICATIONS

Chinese First Office Action for application CN 201380080152.0, dated May 22, 2017, 14 pages.
(Continued)

*Primary Examiner* — Anthony J Salata
(74) *Attorney, Agent, or Firm* — Cantor Colburn LLP

(57) ABSTRACT

An elevator control system includes an elevator group system including one or more elevators and an elevator group controller configured to control operation of the one or more elevators. The system includes at least one of an external elevator management system and an external power provider connected via a data communications link to the elevator group controller. The elevator group controller is configured to transmit to the at least one of the external elevator management system and the external power provider elevator operation information, and the at least one of the external elevator management system and the external power provider is configured to transmit to the elevator group controller elevator operation control information based on the elevator operation information. The elevator group controller is configured to then control operation of the one or more elevators based on the elevator operation control information.

18 Claims, 2 Drawing Sheets

(58) Field of Classification Search
USPC ..... 187/247, 277, 380–388, 391, 393, 290; 705/412
See application file for complete search history.

(56) References Cited

U.S. PATENT DOCUMENTS

| | | | | |
|---|---|---|---|---|
| 5,307,903 | A * | 5/1994 | Morita | B66B 1/18 187/380 |
| 5,398,782 | A * | 3/1995 | Talbot | B66B 5/0006 187/247 |
| 6,269,911 | B1 * | 8/2001 | Richter | B66B 1/34 187/289 |
| 6,655,501 | B2 * | 12/2003 | Kostka | B66B 1/2458 187/247 |
| 8,689,944 | B2 * | 4/2014 | Manfredi | B66B 1/30 187/289 |
| 9,016,440 | B2 * | 4/2015 | Finschi | B66B 1/2458 187/382 |
| 9,327,940 | B2 * | 5/2016 | Hanninen | B66B 1/2491 |
| 9,440,819 | B2 * | 9/2016 | Rossignol | B66B 1/302 |
| 9,533,858 | B2 * | 1/2017 | Hanninen | B66B 1/34 |
| 9,708,156 | B2 * | 7/2017 | Putkinen | B66B 1/2458 |
| 2014/0166407 | A1 * | 6/2014 | Sonnenmoser | B66B 1/2408 187/276 |
| 2016/0171455 | A1 * | 6/2016 | Eleid | G06Q 10/20 705/305 |
| 2016/0304312 | A1 * | 10/2016 | Thompson | G06Q 30/0633 |
| 2018/0231967 | A1 * | 8/2018 | Cohen | G06Q 10/06312 |

FOREIGN PATENT DOCUMENTS

| | | | |
|---|---|---|---|
| KR | 1019920011084 | B1 | 12/1992 |
| KR | 1019970042188 | A | 7/1997 |
| KR | 0179897 | B1 | 7/1998 |
| KR | 1019980027770 | A | 7/1998 |
| KR | 0167191 | B1 | 12/1998 |
| KR | 101257719 | B1 | 5/2013 |

OTHER PUBLICATIONS

Second Chinese Office Action for application CN 201380080152.0, dated Nov. 28, 2017, 4 pages.
International Search Report for application PCT/US2013/063772, dated Jun. 26, 2014, 5 pages.
Written Opinion for application PCT/US2013/063772, dated Jun. 26, 2014, 10 pages.

* cited by examiner

ELEVATOR CONTROL SYSTEM HAVING CONTROLLER IN COMMUNICATION WITH POWER PROVIDER

BACKGROUND OF THE INVENTION

The subject matter disclosed herein relates to elevator control systems and, in particular, to elevator control systems that negotiate with external elevator management systems.

Smart grid systems allow elevators to communicate with devices and systems that are external to the closed elevator system, such as computers and networks outside a building in which the elevator operates. Some applications communicate elevator position information or status information to external devices. Smart grid systems also permit external systems to communicate with the elevator system, such as by sending control information to the elevator system to shut down or start up the elevator.

BRIEF DESCRIPTION OF THE INVENTION

According to one aspect of the invention, an elevator control system includes an elevator group system including one or more elevators and an elevator group controller configured to control operation of the one or more elevators. The system includes at least one of an external elevator management system and an external power provider connected via a data communications link to the elevator group controller. The elevator group controller is configured to transmit to the at least one of the external elevator management system and the external power provider elevator operation information, and the at least one of the external elevator management system and the external power provider is configured to transmit to the elevator group controller elevator operation control information based on the elevator operation information. The elevator group controller is configured to then control operation of the one or more elevators based on the elevator operation control information.

According to another aspect of the invention, an elevator group controller includes memory that stores elevator operation information of one or more elevators in an elevator group and a processor. The processor transmits the elevator operation information to at least one of an external elevator management system and an external power provider, receives elevator operation control information from the at least one of the external elevator management system and the external power provider based on the transmitted elevator operation information, and generates elevator control signals to control operation of the one or more elevators based on the elevator operation control information.

According to another aspect of the invention, a method of controlling an elevator group includes transmitting, by an elevator group controller that controls an operation of one or more elevators, elevator operation information to at least one of an external elevator management system and an external power provider via a data communications link and receiving, by the elevator group controller, from the at least one of the external elevator management system and the external power provider elevator control information based on the elevator operation information. The method further includes controlling, by the elevator group controller, the one or more elevators based on the elevator control information.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Conventional elevator control systems may collect elevator operation information and may control operation of the elevators based on the elevator operation information. However, conventional elevator control systems may have limited interaction with external systems. Embodiments of the invention are directed to elevator control systems in which an elevator group controller exchanges information with external management systems to control operation of the elevators.

Figure 1:
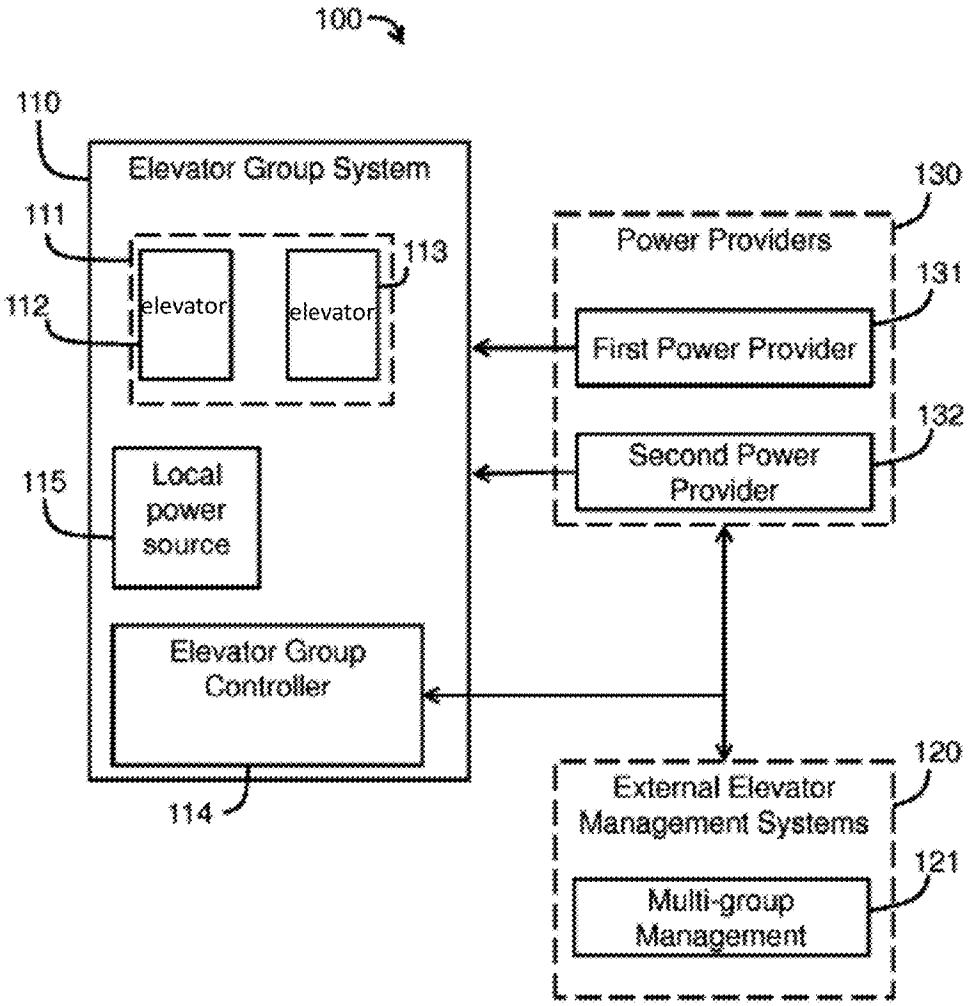
FIG. 1 illustrates an elevator system network according to an embodiment of the invention.

FIG. 1 illustrates an elevator system 100 according to an embodiment of the invention. The system 100 includes an elevator group system 110 and external elevator management systems 120. The elevator group system 110 includes an elevator group 111 including a first elevator 112 and a second elevator 113. An elevator group controller 114 controls the elevators 112 and 113 in the elevator group 111.

While two elevators 112 and 113 are illustrated in the elevator group 111 of FIG. 1, embodiments of the invention encompass any number of elevators in a group, from one up. In one embodiment, the elevator group 111 is made up of all of the elevators in a bank of elevators in a building. For example, if the building includes three banks of elevators at different locations, each bank of elevators may correspond to a different elevator group. In another embodiment, the elevator group 111 corresponds to all of the elevators in a building or other structure. In yet another embodiment, the elevator group 111 corresponds to elevators in multiple buildings or structures, such as all of the elevators located on a particular campus.

Similarly, in one embodiment, the elevator group controller 114 controls the operation of all of the elevators in a bank of elevators in a building. For example, if the building includes three banks of elevators at different locations, each bank of elevators may be controlled by a separate elevator group controller 114. In another embodiment, the elevator group controller 114 controls all of the elevators in a building or other structure. In yet another embodiment, the elevator group controller 114 controls elevators in multiple buildings or structures, such as all of the elevators located on a particular campus.

The elevator group system 110 may also include a local power source 115 to provide power to the elevator group 111 to operate the elevators 112 and 113.

The elevator group controller 114 is connected to the external elevator management systems 120 and power providers 130 via a data link, such as a wire line or wireless communications connection. The external elevator management systems 120 include one or more multi-group management systems 121. The power providers 130 include one or more of a first power provider 131 and a second power provider 132. While each of the first power provider 131, second power provider 132 and multi-group management system 121 are illustrated in FIG. 1 by way of description, embodiments of the invention encompass any combination of the first power provider 131, second power provider 132 and multi-group management system 121 being present, from only one to all of them. Embodiments of the invention further encompass additional external elevator management systems 120 and power providers 130, such as three or more power providers and two or more multi-group management systems. For example, a first multi-group management system may manage multiple elevator groups 111, and a second multi-group management system may manage multiple multi-group management systems, to form a hierarchy of management systems. In addition, while only one elevator group system 110 is illustrated in FIG. 1 for purposes of description, embodiments of the invention encompass multiple elevator group systems 110 connected to the external elevator management systems 120 via data links In operation, the elevator group controller 114 and the external elevator management systems exchange information to control the elevator group 111. In one embodiment, the elevator group controller 114 transmits to the external elevator management systems 120 or power providers 130 elevator operation information. The elevator operation information includes past usage information, present usage information, and future usage information. Usage information includes numbers of ascents and descents, power levels consumed, peak power levels in a predetermined period of time, and average or other time-representative power levels.

In response to receiving the elevator operation information, the external elevator management systems 120 or power providers 130 provide elevator control information to the elevator group controller 114, and the elevator group controller 114 controls the elevators 112 and 113 based on the elevator control information.

In the present specification and claims, elevator control information is defined as information provided from the elevator management systems 120 or power providers 130 to the elevator group controller 114 that is used by the elevator group controller 114 to generate elevator control signals. In one embodiment, the elevator group controller 114 includes a processor and memory, and the elevator group controller generates an elevator operation plan based on the elevator control information and stores the elevator operation plan in memory. The elevator group controller 114 then controls the operation of the elevator group 111 over time based on the elevator operation plan.

Examples of elevator control information include direct control information and indirect control information. Direct control information is information that directs the elevator group controller 114 to control elevators in a particular manner, such as limiting power usage by the elevators (if there is an low-power mode), shutting down elevators, running elevators at certain times, relying on a local power source 115 for a portion of power to the elevator group 111, or any other direct control information.

Indirect control information is information that does not expressly direct the elevator group controller 114 to control the elevator group 111 in a particular way, but is used by the elevator group controller 114 to generate elevator control signals or an elevator control plan. Examples of indirect elevator control information include power cost values, power-limiting values corresponding to a power provider, such as a peak power level permitted by the power provider, average power level permitted by the power provider, maximum sustained power level over a period of time, or any other information that is relevant to operating the elevator group 111 but is not a command to operate the elevator group 111 in a particular way. For example, the first power provider 131 may be an electrical power provider, and may indicate that the electrical power provider has a predetermined maximum power level that the elevator group 111 is permitted to draw over a period of time. The elevator group controller 114 may then generate an elevator operation plan or guidelines to control the elevator group 111 based on the elevator control information.

In an embodiment in which the elevator group system 110 includes a local power source 115, the elevator group controller 114 may control power supplied to the elevator group 111 from the local power source 115 based on the elevator control information obtained from the external elevator management systems 120 or the power providers 130. For example, in an embodiment in which the first power provider 131 is an electrical utility, and the first power provider has a power limit that limits the amount of power the elevator group 111 can draw from the first power provider 131, the elevator group controller 114 may control the local power source 115 to supplement power from the first power provider 131 during peak elevator usage times to meet the power demand of the elevator group 111 and the requirements of the first power provider 131.

The local power source 115 may be any type of power source controlled by the elevator group controller 114, including a battery or battery bank, a generator, a renewable energy source or any other power source.

In one embodiment, the power providers 130 include a first power provider 131 and a second power provider 132. The first power provider 131 and the second power provider 132 may provide the same type of power, such as electrical power, or they may provide different power types, such as one providing electrical power and the other providing gas power. While electrical and gas power are provided by way of example, embodiments of the invention encompass any type of power provider.

In operation, the elevator group controller 114 may transmit elevator operation information to each of the first power provider 131 and the second power provider 132. The first power provider 131 may respond by sending first elevator control information to the elevator group controller 114, and the second power provider 132 may respond by sending second elevator control information to the elevator group controller 114. The elevator group controller 114 may analyze the first and second elevator control information, and may control the operation of the elevator group 111 based on both the first and second elevator control information. In one embodiment, the elevator group controller 114 adjusts a ratio of power supplied to the elevator group 111 from the first power provider 131 relative to the second power provider 132 based on the first and second elevator control information. For example, if the first power provider 131 is an electrical power provider and the second power provider 132 is a gas power provider that drives a gas generator of the elevator group system 110, the elevator group controller 114 may determine the most cost-effective or power-effective ratio of driving the elevator group 111 with the electrical power from the first power provider 131 and with the gas from the second power provider 132.

In one embodiment, the elevator group controller 114 negotiates with the external elevator management systems 120 and the power providers 130. In such an embodiment, the elevator group controller 114 transmits the elevator operation information to the external elevator management systems 120 and power providers 130, the external elevator management systems 120 and power providers 130 transmit the elevator control information to the elevator group controller 114, and the elevator group controller 114 transmits back to the external elevator management systems 120 and power providers 130 adjusted elevator operation information to receive from the external elevator management systems 120 and power providers 130 adjusted elevator control information. For example, the first power provider 131 may provide to the elevator group controller 114 power rates based on an elevator usage plan provided to the first power provider 131 from the elevator group controller 114. The elevator group controller 114 may then alter the elevator usage plan and submit the adjusted plan to the first power provider 131 to receive more favorable power rates.

In one embodiment of the invention, the elevator system 100 includes multiple elevator group systems 110 connected to the external elevator management systems 120 and power providers 130. In such an embodiment, the multi-group management system 121 coordinates operations of the elevator groups 111 of each elevator group system 110. In one embodiment, the multi-group management system 121 gathers elevator operation information from each of the multiple elevator group systems 110. The multi-group management system 121 then stores the operation information electronically, analyzes the operation information from the elevator group systems 110 with elevator management processing circuitry, and generates the elevator operation control information to coordinate operation of all of the elevator group systems 110.

Figure 2:
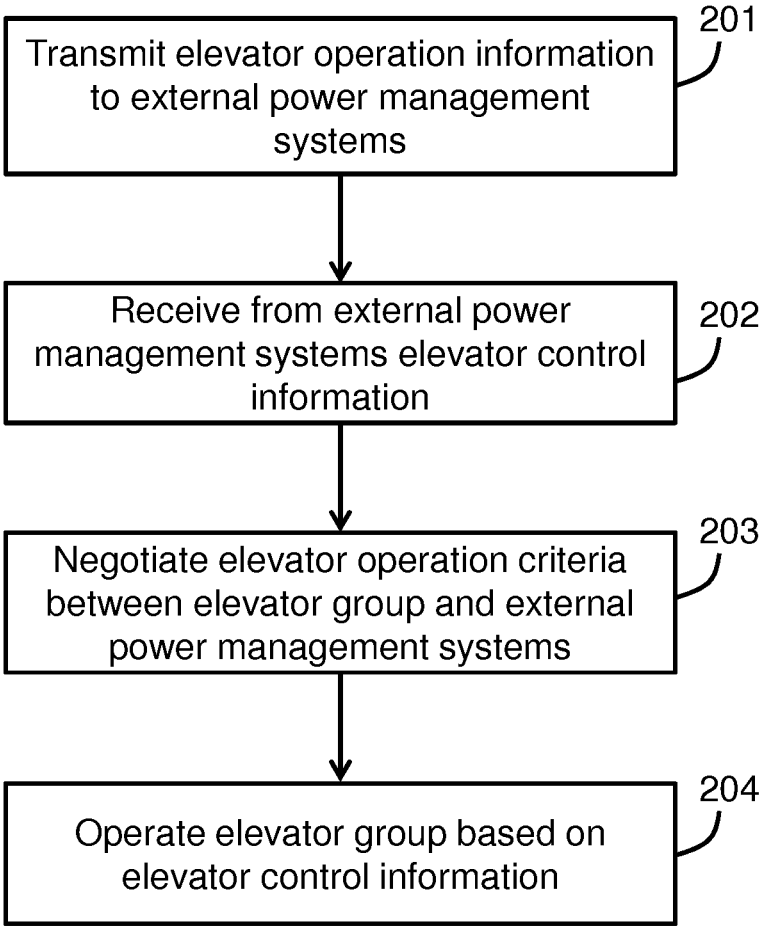
FIG. 2 illustrates a block diagram of a method for controlling the elevator system according to an embodiment of the invention.

FIG. 2 is a flow chart illustrating a method according to an embodiment of the invention. In block 201, an elevator group controller transmits elevator operation information to an external elevator management system or power provider via a data communications link. In block 202, the elevator group controller receives elevator control information from the external elevator management system or power provider based on the elevator operation information. In block 203, the elevator controller negotiates with the power management system or power provider. For example, the elevator controller may transmit adjusted elevator operation information to the external elevator management system and may receive, in return, adjusted elevator control information.

In block 204, the elevator group controller controls the elevators of the elevator group based on the elevator control information or adjusted elevator control information.

Accordingly, embodiments of the invention encompass methods, systems, devices and other assemblies for communicating with elevator management systems and power providers external to an elevator group system, exchanging information with the elevator management systems and power providers, and controlling the elevator group based on the information exchanges. Embodiments of the invention allow elevator systems to optimize energy storage and management strategies in real-time, while meeting any requirements imposed by external elevator management systems connected to the elevator group system electronically, such as via a smart grid.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator control system, comprising:

an elevator group system including one or more elevators and an elevator group controller configured to control operation of the one or more elevators; and a power provider connected via a data communications link to the elevator group controller, the elevator group controller configured to transmit to the power provider elevator operation information, the power provider configured to transmit to the elevator group controller elevator control information based on the elevator operation information, and the elevator group controller configured to control operation of the one or more elevators based on the elevator control information.

2. The elevator control system of claim 1, wherein the power provider includes a power provider that provides power to the one or more elevators, and the elevator control information includes at least one of information regarding the cost to provide power to the one or more elevators and power information corresponding to a power range in which the one or more elevators is to operate.

3. The elevator control system of claim 1, wherein the elevator group system includes a local power supply controlled by the elevator group controller, and the elevator group controller is configured to supply power to the one or more elevators from the local power supply based on the elevator operation control information.

4. The elevator control system of claim 1, wherein the power provider includes a first power provider that provides a first power type and a second power provider that provides a second power type, and the elevator group controller receives first elevator control information from the first power provider and second elevator control information from the second power provider and adjusts a ratio of power supplied to the one or more elevators from the first power provider relative to the second power provider based on the first and second elevator control information.

5. The elevator control system of claim 4, wherein the first power provider is an electrical power provider connected to the one or more elevators via an electrical grid, and the second power provider is an alternative power provider other than an electrical power provider.

6. The elevator control system of claim 1, wherein the elevator group controller is configured to communicate with the power provider based on receiving the elevator control information to obtain adjusted elevator control information, and the elevator group controller is configured to control the one or more elevators based on the adjusted elevator control information.

7. An elevator group controller, comprising:

memory that stores elevator operation information of one or more elevators in an elevator group; and a processor that transmits the elevator operation information to an external power provider, receives elevator control information from the external power provider based on the transmitted elevator operation information, and generates elevator control signals to control operation of the one or more elevators based on the elevator control information.

8. The elevator group controller of claim 7, wherein the external power provider is a power provider that provides power to the one or more elevators, the elevator operation control information is at least one of power cost information and power-level-limit information, and the processor controls operation of the one or more elevators based on at least one of power cost information and power-level-limit information.

9. The elevator group controller of claim 7, wherein the processor is configured to communicate with the external power provider based on receiving the elevator control information to obtain adjusted elevator control information, and the processor is configured to generate the elevator control signals to control operation of the one or more elevators based on the adjusted elevator operation control information.

10. The elevator group controller of claim 9, wherein the elevator control information includes at least one of power cost information and elevator-power-limiting information to limit power levels at which the one or more elevators operate, and the communication includes transmitting to the external power provider at least one of power cost values and power usage levels different than the power cost information and elevator-power-limiting information provided by the external power provider based on an expected usage of the one or more elevators.

11. The elevator group controller of claim 10, wherein the processor is configured to control a local power source to supply at least a portion of the power provided to the one or more elevators from the local power source, and at least a portion of the power supplied to the one or more elevators from an electrical grid, a portion of the power provided to the one or more elevators from the local power source and the portion of the power supplied to the one or more elevators from an electrical grid being based on the elevator control information.

12. A method of controlling an elevator group, comprising:

transmitting, by an elevator group controller that controls an operation of one or more elevators, elevator operation information to an external power provider via a data communications link;

receiving, by the elevator group controller, from the external power provider elevator control information based on the elevator operation information; and controlling, by the elevator group controller, the one or more elevators based on the elevator control information.

13. The method of claim 12, wherein the external power provider includes a power provider that provides power to the one or more elevators, and the elevator control information includes at least one of information regarding the cost to provide power to the one or more elevators and power information corresponding to a power range in which the one or more elevators is to operate.

14. The method of claim 12, further comprising:

controlling, by the elevator group controller, power supplied to the one or more elevators from a local power supply controlled by the elevator group controller and from the at least one of the external elevator management system and the external power provider based on the elevator control information.

15. The method of claim 12, wherein the external power provider includes a first power provider that provides a first power type and a second power provider that provides a second power type, receiving the elevator control information includes receiving first elevator control information from the first power provider and second elevator control information from the second power provider, and the method further comprises:

controlling, by the elevator group controller, a ratio of power supplied to the one or more elevators from the first power provider and the second power provider based on the first elevator control information and the second elevator control information.

16. The method of claim 15, wherein the first power provider is an electrical power provider connected to the one or more elevators via an electrical grid, and the second power provider is an alternative power provider other than an electrical power provider.

17. The method of claim 12, further comprising:

communicating, by the elevator group controller, with the external power provider based on receiving the elevator control information to obtain adjusted elevator control information, wherein controlling the one or more elevators includes controlling the one or more elevators based on the adjusted elevator control information.

18. The method of claim 12, wherein transmitting, by an elevator group controller, elevator operation information to the external power provider includes transmitting, by a plurality of elevator group controllers, each configured to control a separate group of one or more elevators, elevator operation information to the external power provider.

* * * * *